US010059474B2

(12) United States Patent
Gross

(10) Patent No.: US 10,059,474 B2
(45) Date of Patent: Aug. 28, 2018

(54) PACKAGING DEVICE FOR MEDICATIONS

(71) Applicant: CareFusion Germany 326 GmbH, Kelberg (DE)

(72) Inventor: Dietmar Gross, Kelberg (DE)

(73) Assignee: CAREFUSION GERMANY 326 GMBH, Kelberg (DE)

( * ) Notice: Subject to any disclaimer, the term of this patent is extended or adjusted under 35 U.S.C. 154(b) by 646 days.

(21) Appl. No.: 14/598,502

(22) Filed: Jan. 16, 2015

(65) Prior Publication Data

US 2016/0207647 A1 Jul. 21, 2016

(51) Int. Cl.

| | |
|---|---|
| ***B65B 9/067*** | (2012.01) |
| ***B65B 65/06*** | (2006.01) |
| ***B65B 1/04*** | (2006.01) |
| *B65B 61/02* | (2006.01) |

(52) U.S. Cl.

CPC ..... *B65B 9/067* (2013.01); *B65B 61/025* (2013.01); *B65B 2210/06* (2013.01)

(58) Field of Classification Search

CPC ..... B65B 9/08; B65B 9/067; B65B 61/025; B65B 2210/06; B65B 1/04; B65B 5/103; B65B 51/28; B29C 65/18; B29C 66/83413; B29C 66/83513; B29C 66/849; B29C 66/934

USPC ... 53/450, 568, 168, 550, 555, 374.3–376.2, 53/548, 551

See application file for complete search history.

(56) References Cited

U.S. PATENT DOCUMENTS 5,722,215 A * 3/1998 Yuyama ..... B29C 65/18 156/465
5,875,610 A * 3/1999 Yuyama ..... B29C 66/1122 53/168
2003/0019190 A1 1/2003 Kim

FOREIGN PATENT DOCUMENTS

WO WO-2013034504 A1 3/2013
WO WO 2013176170 A1 11/2013

OTHER PUBLICATIONS

Search Report from corresponding EP 15151360.3 dated Jun. 1, 2015 (4 pages).
International Preliminary Report on Patentability for Application No. PCT/EP2016/050544, dated Jul. 18, 2017, 6 pages.

* cited by examiner

*Primary Examiner* — Robert Long
*Assistant Examiner* — Xavier A Madison
(74) *Attorney, Agent, or Firm* — McDermott Will & Emery LLP

(57) ABSTRACT

A packaging device for medications includes a packaging material supply and a folding and guiding unit. The folding and guiding unit folds a packaging material web in the longitudinal direction so that the edges of the packaging material web are guided along packaging material web folding regions and a folding section establishes a folded region in the packaging material web. The folding and guiding unit includes an impact region for medications to be packaged, a first joining unit and a second joining unit. The folding and guiding unit also includes a medication supply section spaced apart from the folding section and via which medications are conducted vertically spaced apart from the folded region into the folded packaging material web.

18 Claims, 13 Drawing Sheets

PACKAGING DEVICE FOR MEDICATIONS

BACKGROUND

The disclosed embodiments relate to a packaging device for medications and in particular a packaging device for use in an automatic blister packaging machine.

In many medical treatment settings, it is desirable to provide a packaging device for medications for which the supply of medications into a pre-folded packaging material allows shorter medication packs to be created. For example, a packaging device for which medications may be arranged not only one after another in the movement direction of the packaging material web, but also one on top of another, such that the same number of medications may be packaged in a smaller blister pack.

SUMMARY

The disclosed embodiments provide a packaging device for medications. The packaging device includes a packaging material supply configured to supply a flexible, elongated packaging material web from a storage roll and a folding and guiding unit disposed downstream of the packaging material supply. The folding and guiding unit includes a packaging material web receiving region, first and second packaging material web folding regions configured to run together in a folding section, an impact region and a medication supply section. The folding and guiding unit is configured to fold the packaging material web in a longitudinal direction so that the edges of the packaging material web are guided along the first and second packaging material web folding regions and a folded region in the packaging material web is formed by the folding section, wherein the impact region is configured for medications to be packaged, and wherein the medication supply section is spaced apart from the folding section, the medication supply section configured to guide medications vertically spaced apart from the folded region into the folded packaging material web. The packaging device also includes a first joining unit disposed downstream of the folding and guiding unit and configured to join together the folded packaging material web in an axial direction. The packaging device further includes a second joining unit disposed downstream of the folding and guiding unit and configured to join together the folded packaging material web in a longitudinal direction.

The disclosed embodiments also provide a method for packaging medications. The method includes feeding a packaging material web into a folding and guiding device and folding the packaging material web in a longitudinal direction into a funnel configuration, the folded packaging material web comprising a packaging region. The method also includes guiding, by an impact region of the folding and guiding device, one or more dispensed medications into the packaging region. The method further includes joining opposing sides of the folded packaging material web together in an axial direction by a first joining unit. The method also includes joining opposing longitudinal sides of the folded packaging material web together in a longitudinal direction by a second joining unit, the opposing longitudinal sides of the folded packaging material web disposed opposite a fold in the folded packaging material web, wherein the axially and longitudinally joined folded packaging material web form a sealed package containing the dispensed medications.

The disclosed embodiments provide a packaging device. The packaging device includes a folding and guiding unit. The folding and guiding unit includes first and second packaging material web folding regions configured to fold a packaging material web in a longitudinal direction to form a folded packaging material web having a longitudinal fold. The folding and guiding unit also includes a medication supply section configured to guide a plurality of medications into the folded packaging material web, wherein two or more of the plurality of medications are disposed next to one another axially from the longitudinal fold. The packaging device also includes a first joining unit configured to join together the folded packaging material axially from the longitudinal fold. The packaging device further includes a second joining unit configured to join together the folded packaging material web longitudinally opposite the longitudinal fold.

The foregoing and other features, aspects and advantages of the disclosed embodiments will become more apparent from the following detailed description and accompanying drawings.

DETAILED DESCRIPTION

Figure 1A:
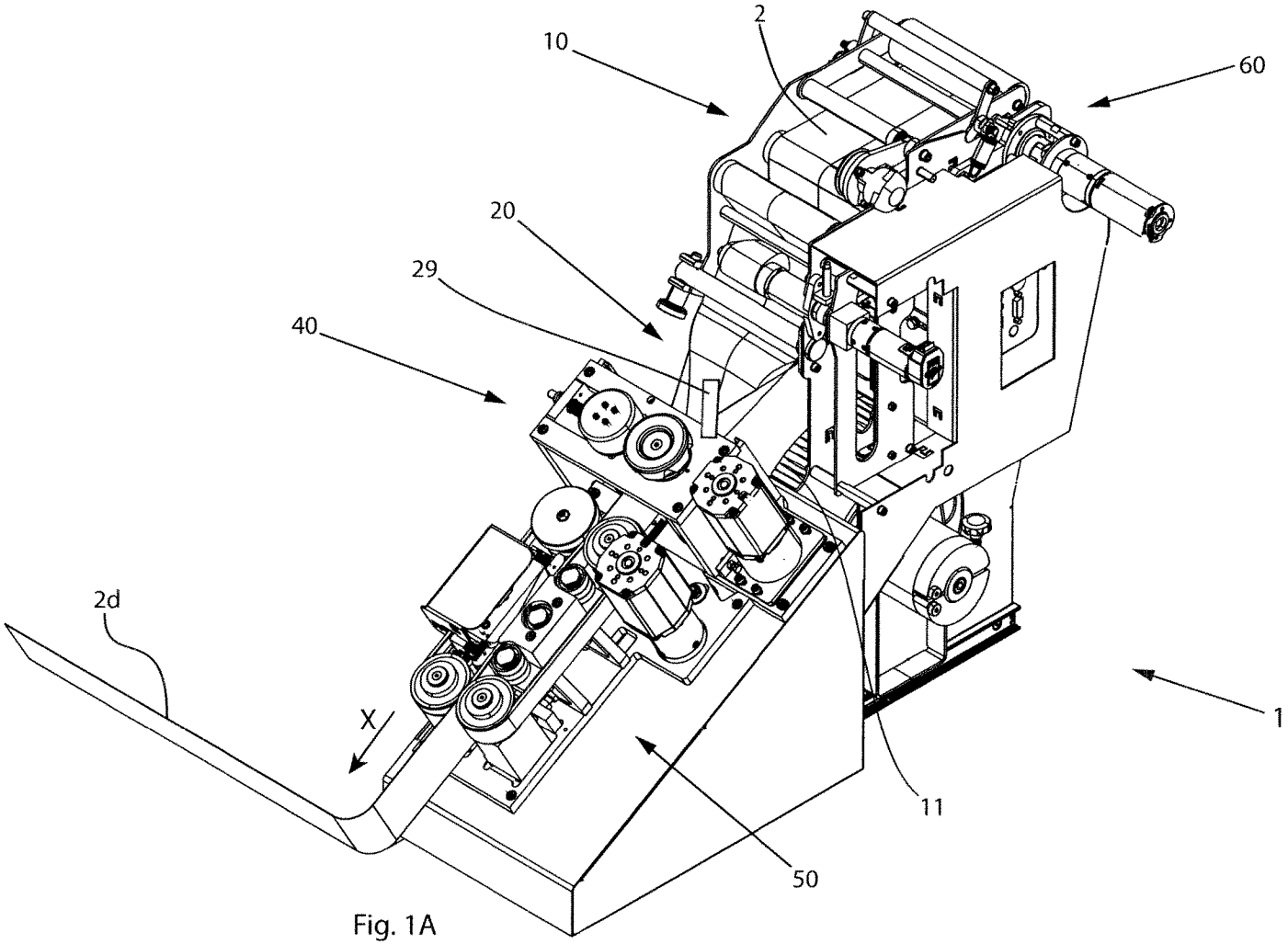
FIG. 1A is a perspective view of an embodiment of a packaging device having packaging material web guided through the device.

The detailed description set forth below describes various configurations of the subject technology and is not intended to represent the only configurations in which the subject technology may be practiced. The detailed description includes specific details for the purpose of providing a thorough understanding of the subject technology. Accordingly, dimensions are provided in regard to certain aspects as non-limiting examples. However, it will be apparent to those skilled in the art that the subject technology may be practiced without these specific details. In some instances, well-known structures and components are shown in block diagram form in order to avoid obscuring the concepts of the subject technology.

It is to be understood that the present disclosure includes examples of the subject technology and does not limit the scope of the appended claims. Various aspects of the subject technology will now be disclosed according to particular but non-limiting examples. Various embodiments described in the present disclosure may be carried out in different ways and variations, and in accordance with a desired application or implementation.

Within the scope of this application, the term "individual item" is regularly used, with this formulation intended to also include the plural. For example, in using the operating device an individual item or a plurality of individual items may be simultaneously slotted and picked.

Automatic blister packaging machines are usable in pharmacies and hospitals, and with corresponding dimensioning in blister packaging centers, by compiling medications individually by patient in accordance with the times for taking them ordered by the physician. The packaging device of the automatic blister packaging machine packages the medication sets, which may contain only one medication or a plurality of individual medications, into a pouch formed from an endless packaging material web (e.g., blister pack). The pouch leaves the packaging device for further use as a "blister tube" (e.g., the concatenated filled blister packs that are not yet separated). A blister pack generally corresponds to a time for taking a medication of a patient as it contains all medications which a patient must take in the morning, for example.

The typical automatic blister packaging machine includes multiple storage and discharge units for medications, which interact with multiple revolving guiding units, which supply the medications to collecting units, which also revolve, and via which the medication sets are supplied to a packaging device. The automatic blister packaging machine may provide a plurality of medication sets in a short time, which places special demands on the packaging device.

In some packaging devices, the provided medication sets are supplied to the device itself via corresponding transport units and packaged in the packaging device into blister packs (e.g., blister packaging). The medication set is transferred to the packaging device at a predefined position. This takes place, for example, in that the transport unit is temporarily opened, upon which the medication set falls onto an impact plate provided for this purpose. The impact plate is simultaneously used as a shaper/folding aid for a packaging material web guided past it (e.g., from which the packaging device shapes the individual blister packs). The packaging material web is typically folded in this case along the longitudinal axis such that the folding region is arranged below. The individual medications of the medication set slip down from the impact plate into the folding region, where a stop is generally formed by the vertical welding of the preceding pouch.

Because of the alignment of the impact plate and the folded packaging material web, the movement direction of the packaging material web and the construction of the impact plate cause the medications to be packaged to lie one behind another in the pre-folded packaging material web. In dependence on the number of the medications, relatively long pouches can thus result, which leads to material wastage and lengthening of the duration in time of the packaging.

In dependence on the shape of the medication to be packaged, the geometry of the impact plate causes the medication to be supplied to the pre-folded section of the packaging material web such that problems can occur during the closing of the pre-folded filled section of the packaging material web and its further transport through the packaging device. For example, tablets in the form of a flat circular cylinder on an end face.

Accordingly, packaging device for medications is provided in which a supply of medications into a pre-folded packaging material web is such that shorter medication packs may be created. The packaging device may have a packaging material supply for supplying a flexible, elongated packaging material web from a storage roll and a folding and guiding unit arranged downstream of the packaging material supply. The term "downstream" relates in this case to the movement direction of the packaging material web, originating from the storage roll and through the packaging device.

The folding and guiding unit includes a packaging material web receiving region and two packaging material web folding regions that run together in a folding section, and which is arranged opposite to the receiving region of the folding and guiding unit. The folding and guiding unit of the packaging device according to the invention folds the packaging material web in the longitudinal direction, so that the edges of the packaging material web are guided along the packaging material web folding regions and the folding section establishes a folded region in the packaging material web, whereby a folded packaging material web having a U-shaped cross section results to some extent.

During the packaging operation, the medication is supplied to this pre-folded U-shaped region of the packaging material web, which is continuously formed during movement of the packaging material web. This region is hereafter referred to as the "packaging region." The folding and guiding unit comprises an impact region for medication to be packaged, wherein the medication is guided by this impact region into the packaging region of the folded packaging material web.

The packaging device includes a first joining unit arranged downstream of the folding and guiding unit, by which the folded packaging material web is joined together vertically in relation to the longitudinal direction, wherein typically two vertical joining regions (e.g., first and second axial seals) are produced per pharmaceutical pack or blister pack to be produced, for example. Since the blister pack may not be separated in the device after the packaging or production, a joining region may be used as one end of a preceding blister pack and a beginning of a new blister pack. However, two separate vertical joining regions may also be created per blister pack in dependence on the precise configuration of the first joining unit.

The packaging device also includes a second joining unit arranged downstream of the folding and guiding unit, using which the folded packaging material web is joined together in parallel to the longitudinal direction and opposite to or spaced apart from the folded region. The sequence in which the first and second joining units are arranged in relation to the movement direction of the packaging material web inside the packaging device is not essential for the present disclosure and is dependent on design details of the packaging device. For example, the first joining unit may be arranged after the folding and guiding unit.

The folding and guiding unit includes a medication supply section, which is spaced apart from the folding section, and via which the medication to be packaged is guided vertically spaced apart from the folding region into the folded packaging material web. The folded packaging material web may be joined together vertically downstream of the supply region (e.g., the packaging region).

In typical packaging devices, flat impact plates are used, by means of which the medication to be packaged is supplied, in vertical proximity to the folded region, to the packaging region. This generally has the result that the medications, because of the progressive movement of the packaging material web during the packaging, are arranged essentially one behind another, so that the volume of the medication pack created in the course of the blister packaging is insufficiently utilized and the resulting blister pack is relatively long (e.g., in relation to the longitudinal direction of the packaging material web).

In aspects of the present folding and guiding unit, the medications are guided vertically spaced apart from the folded region into the packaging region, so that the medications firstly fall down, stopped by the vertical joining region or axial seal of the preceding medication pack, onto the folded region and subsequent medications are optionally arranged over already supplied medications. The medications to be supplied no longer obstruct one another mutually, so that at uniform speed the same number of medications may be packaged more rapidly and in a shorter medication pack, since the medications are arranged therein not only one behind another, but rather also one on top of another. Thus, the supply of the individual medications of the medication set is accordingly improved such that shorter medication packs may be created, which results, inter alia, in a material savings with regard to the packaging material. However, more rapid blister packaging may also be provided simultaneously, since the device may be operated more rapidly because of the lesser obstruction of the individual medications among one another during the supply.

In use with some impact plates, circular-cylindrical medications can be supplied on their end face to the folded packaging material web region. If medications having a relatively large radius are to be packaged, it can thus occur that they are supplied and packaged vertically in relation to the movement direction of the packaging material web, with respect to their radius, which can result in problems in the following joining regions in dependence on the size of the medications and the filling of a folded packaging material web region to be closed. For example, if the folded packaging material web bulges out too strongly, it may be too flat to be joined together in the second joining unit in parallel to the longitudinal unit, since the packaging material web simply no longer reaches the actual joining region of the joining unit.

In a preferred embodiment of the packaging device, it is provided that the surface of the folding and guiding unit which provides the impact region is configured as concave. This has the result, on the one hand, that the impact region has a steeper angle of inclination (e.g., in comparison to a surface without concave embodiment), but the medication supply section arranged in the tip of the triangular folding and guiding unit is implemented as flat or, in contrast, so that the surface of the folding and guiding unit represents a ski jump configuration. Thus, the medications are guided particularly effectively and in an oriented manner (e.g., approximately parallel to the joining region) into the pre-folded region of the packaging material web. A vertical joining region of the preceding medication pack forms a stop for the medications therein, from which the medications fall down to the folded region, so that an arrangement one on top of another is more probable.

During the impact of the medications in the impact region of the folding and guiding unit, extremely small medication particles regularly split off and contaminate the surface of the folding and guiding unit. Subsequent medications may entrain the contaminant particles, so that increasing contamination of the medications in the medication packs may take place over time. It is therefore typically necessary to regularly replace the folding and guiding unit, which is time-consuming and requires an undesired interruption of the blister packaging.

In a preferred embodiment, it is provided that the folding and guiding unit has a detachable medication supply component and a folding component, wherein the supply section is part of the detachable medication supply component and the folding section is part of the folding component. As soon as a certain level of contamination is reached, only the detachable medication supply component that comes into contact with the medications must be replaced. The folding component, which ensures the guiding and folding of the packaging material web, may remain in the packaging device. The replacement can therefore be carried out substantially more rapidly, since it is no longer necessary to insert the entire folding and guiding unit in the guide path of the packaging material web.

As described above, it is preferable that medications may also be arranged one on top of another in the packaging region. An optimal arrangement of the medications in the folded region of the packaging material web is dependent on the distance of the supply section to the folded region of the packaging material web, more precisely on the distance of the upper side of the supply section to the lower side of the folded section. To be able to set this distance ideally, it is provided in a preferred embodiment that the detachable medication supply component is mounted so it is pivotable.

As discussed above, the contamination of the surface of the folding and guiding unit is problematic and requires a cleaned surface to be regularly provided. This may be performed, for example, in that the folding and guiding unit, or at least a component of this unit, is replaced. To lengthen the intervals between the provision of a cleaned surface, it is provided in a preferred embodiment of the packaging device that the surface of the folding and guiding unit which provides the impact region is at least sectionally provided with an anti-adhesive coating, making it more difficult for medication particles that have split off to adhere. Thus, medication particles which split off are conducted with the medications into the folded packaging material web and do not remain on the surface.

In a further preferred embodiment, a cleaning unit, by which contaminants adhering to the surface of the folding and guiding unit may be removed, is assigned to the folding and guiding unit. This can be performed, for example, in that a fluid is applied to the surface of the folding and guiding unit, which flushes the adhering contaminants into the packaging material web. The contaminated region of the packaging material web is joined together as usual to form a pouch and subsequently disposed of or discarded. For example, a cleaning liquid may be used as the cleaning fluid. In the embodiment of the cleaning unit and the guiding of the cleaning fluid, it is to be ensured that the contaminant particles are not flushed into other regions of the packaging device.

The packaging material web is provided to the folding and guiding unit via the packaging material supply, specifically typically from a storage roll, which can be arranged in a special section of the packaging device. In particular, in large blister packaging centers large quantities of medications are blister packaged, often in repeating sequence, so that the storage roll can have already finished printed or marked packaging material web regions. In such a case, a spontaneous change of the medication to be packaged is only possible if the storage roll having the already marked packaging material web is replaced. To be flexible with regard to the medication to be packaged, it is provided in a preferred embodiment of the present packaging device that it includes a marking unit, by which the packaging material web is marked in accordance with the medications to be packed or the already packed medications. Corresponding markings may be printed on the packaging material web, so that it is preferable for the marking unit to be arranged upstream of the folding and guiding unit, so that a packaging material web which is not yet folded may be printed.

Figure 1B:
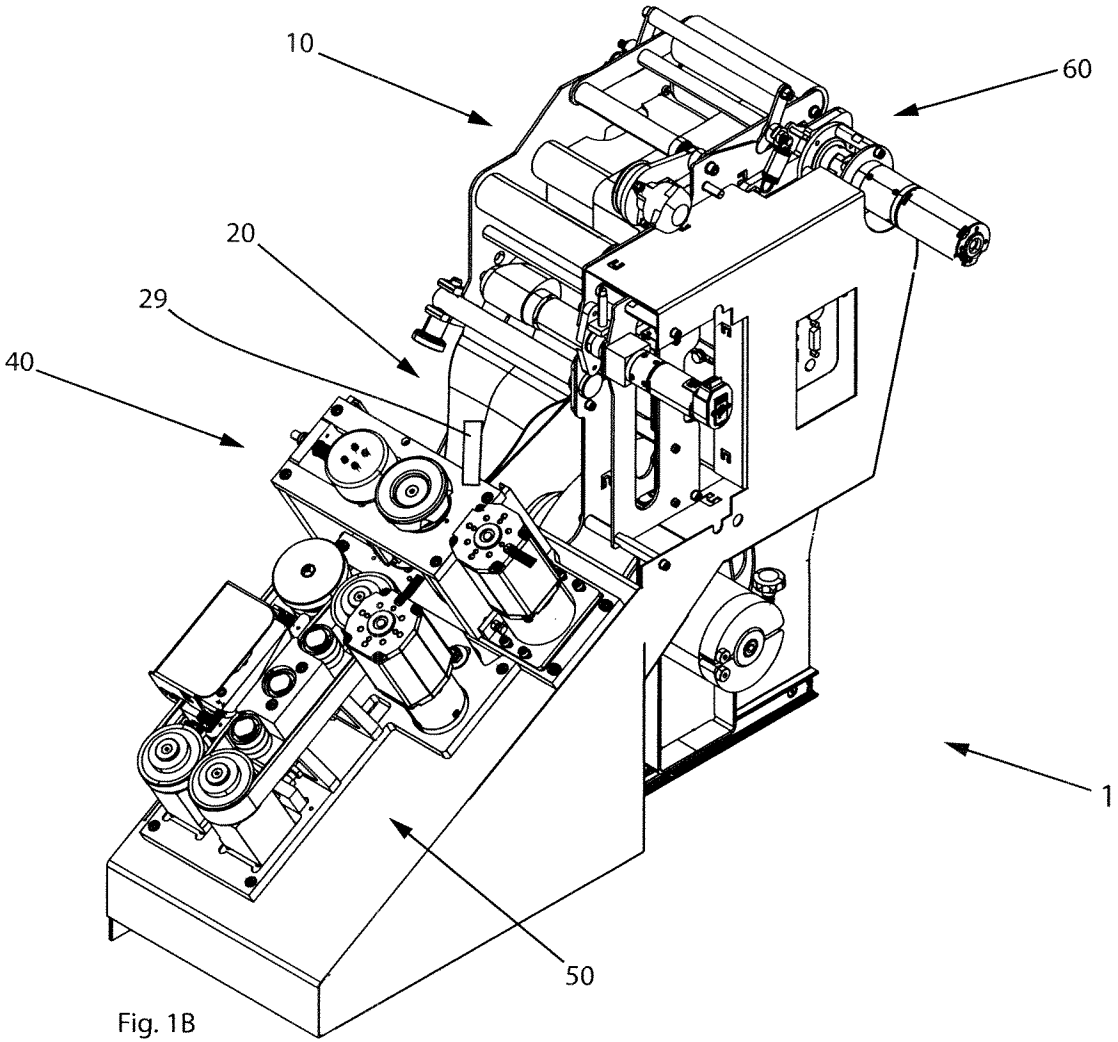
FIG. 1B is a perspective view of the packaging device of FIG. 1 without the packaging material web.

FIGS. 1A and 1B show perspective views of an embodiment of a packaging device 1. As shown in FIG. 1A, a packaging material web 2 guided through the device is shown in the upper region, which leaves the device as a blister tube 2*d*. The blister tube 2*d* is formed during the passage through the device. The packaging material web 2 and the blister tube 2*d* are left out in FIG. 1B, otherwise the figures are substantially the same.

The illustrated embodiment of the packaging device 1 includes a storage roll 11, on which the packaging material web 2 is stored, and which is shaped into pouches and filled with medications as it passes through the packaging device 1. The packaging material web 2 is supplied from the storage roll 11 to a folding and guiding unit 20 using a packaging material supply 10, wherein a marking unit 60 is also arranged between storage roll and folding and guiding unit 20 in the embodiment shown, by which items of information may be applied to the packaging material web 2.

With the aid of the folding and guiding unit 20, which is triangular in this embodiment, and a following first joining unit 40, the packaging material web 2 is folded in the longitudinal direction to form a U-shaped double web, wherein the two "legs" of the double web are generally of equal width and/or height. The precise way in which the actual folding operation of the packaging material web 2 and the filling of the folded packaging material web 2, which takes place in the same section of the packaging device 1, are carried out will be described in greater detail with reference to the following figures.

Using the first joining unit 40, which is arranged downstream of the folding and guiding unit 20, the folded packaging material web 2, which is filled with medications, is joined together vertically in relation to the longitudinal direction or movement direction X of the packaging material web 2 (see FIG. 1), wherein a joining region simultaneously represents the beginning of a new (e.g., not yet closed) blister pack and the end of the preceding blister pack. In the embodiment shown, the first joining unit 40 is implemented by a welding unit, by which the folded double web is welded vertically in relation to the longitudinal direction. A cleaning unit 29 is fastened on the first joining unit 40, by which a cleaning fluid may be applied to the surface of the folding and guiding unit 20, to remove contaminants from the surface.

A second joining unit 50 is arranged downstream of the first joining unit 40, by which the folded double web, which is filled with medications and is already provided with vertical joining regions, is joined together in parallel to the longitudinal direction and spaced apart from the fold of the packaging material web, wherein this is again implemented by welding in the embodiment shown. The finished blister tube 2*d* is guided out of the automatic blister packaging machine 1 and supplied to inspection and separation (e.g., patient-related).

Figure 2A:
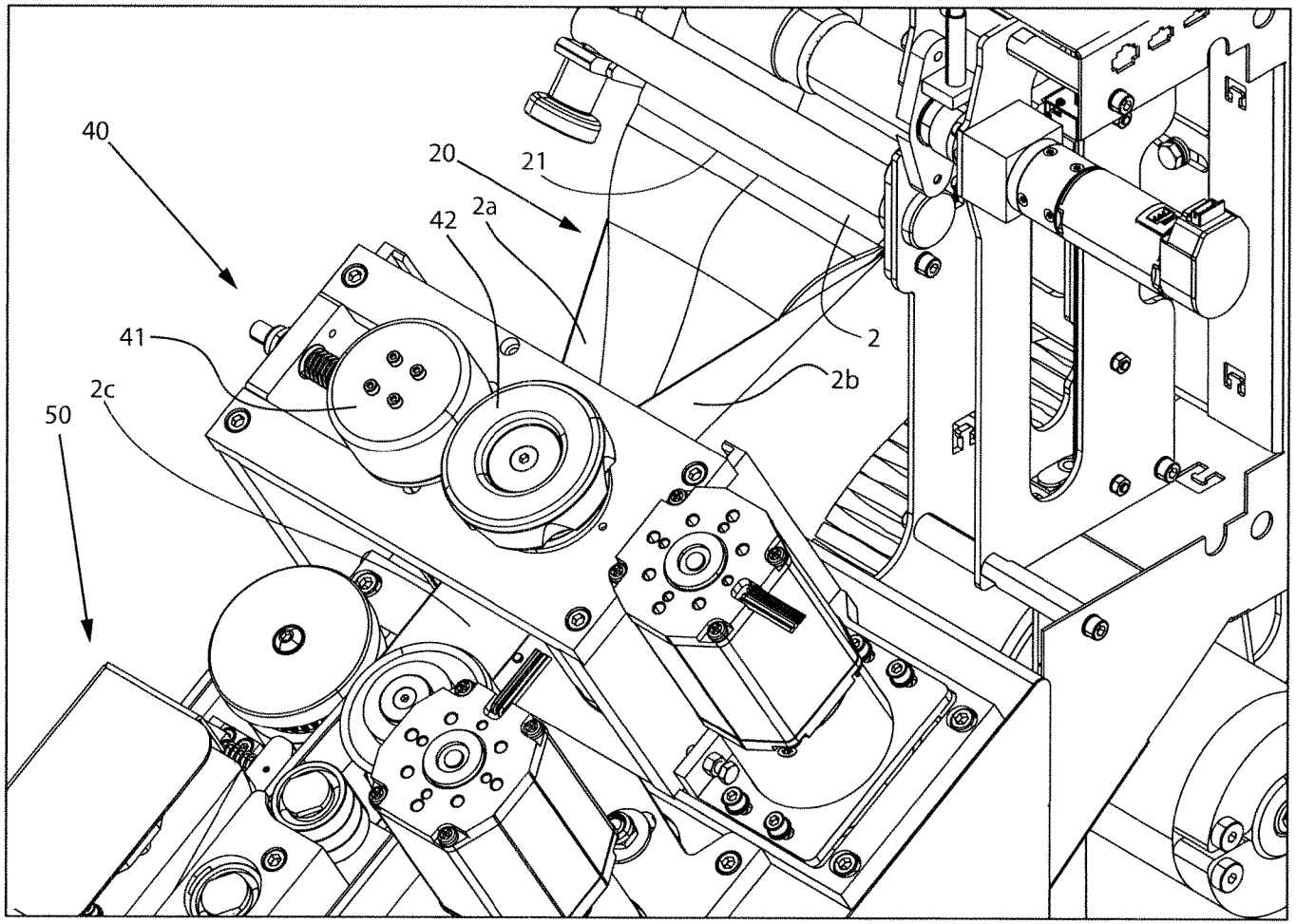
FIG. 2A is a perspective view of a portion of an embodiment of a packaging device.

FIGS. 2A-2E show detail views of one embodiment of the packaging device in the region of the folding and guiding unit 20. As can be seen in FIG. 2A, the packaging material web 2 is folded with the aid of the folding and guiding unit 20 and the first joining unit 40 to form a double web 2*c*.

For this purpose, the unfolded packaging material web 2 is guided at a packaging material web receiving region 21 under the triangular folding and guiding unit 20. Sections 2*a*, 2*b* of the packaging material web 2 protrude at the lateral regions of the folding and guiding unit 20. At the tip of the folding and guiding unit 20 (not shown in FIG. 2A), the folding region is established, i.e., the region in which the actual folding of the packaging material web takes place. The fold of the double web 2*c* is maintained in this case by the first joining unit 40 downstream from the folding and guiding unit 20.

FIG. 2A also shows several details of the first joining unit 40, specifically two welding rollers 41, 42, which are aligned vertically in relation to the longitudinal direction or movement direction of the packaging material web 2 (e.g., double web 2*c*), and using which welded regions or joining regions oriented vertically in relation to the longitudinal direction of the packaging material web 2 are implemented.

During the blister packaging, the welding rollers 41, 42 rotate, wherein the rotational velocity is adapted to the pouch length and the movement velocity of the packaging material web 2. In the illustrated embodiment, each welding roller comprises two opposing welding sections 41*a*, 41*b*, 42*a*, 42*b* (see FIG. 2B) and the welding rollers 41, 42 only have contact in these regions with the double web 2*c* guided between them during the rotation. The welding sections 41*a*, 41*b*, 42*a*, 42*b* are adapted to one another, so that during the progression of the double web 2*c* and rotation of the welding rollers 41, 42, these come into contact with the double web 2*c* every X centimeters and implement a joining region 4. The path length of the "noncontact" between welding sections 41*a*, 41*b*, 42*a*, 42*b* and the double web 2*c* defines the length of the blister pack.

Figure 2B:
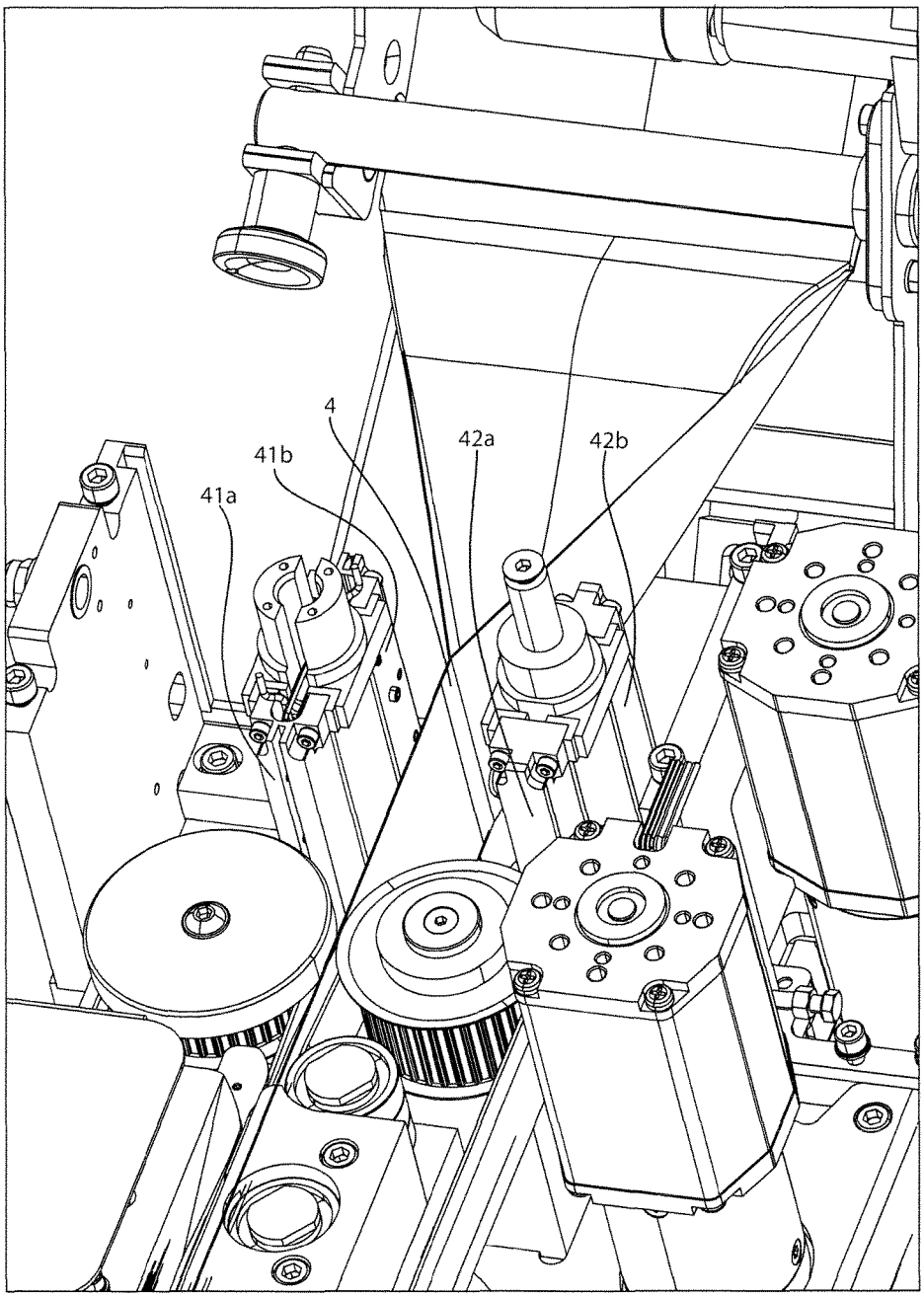
FIG. 2B is a perspective view of a portion of an embodiment of a packaging device.

The illustration according to FIG. 2B is only used to illustrate the rollers/contact regions. As is apparent, the joining region 4 is at the height of the axes of the welding rollers 41, 42 in the movement direction of the packaging material web 2 (e.g., where the joining region 4 is introduced) such that the rollers 41, 42 would have to be shown rotated by 90° to reproduce this welding which has just taken place. However, the illustration of FIG. 2B is intended to provide greater comprehension of the structures and functions described.

Figure 2C:
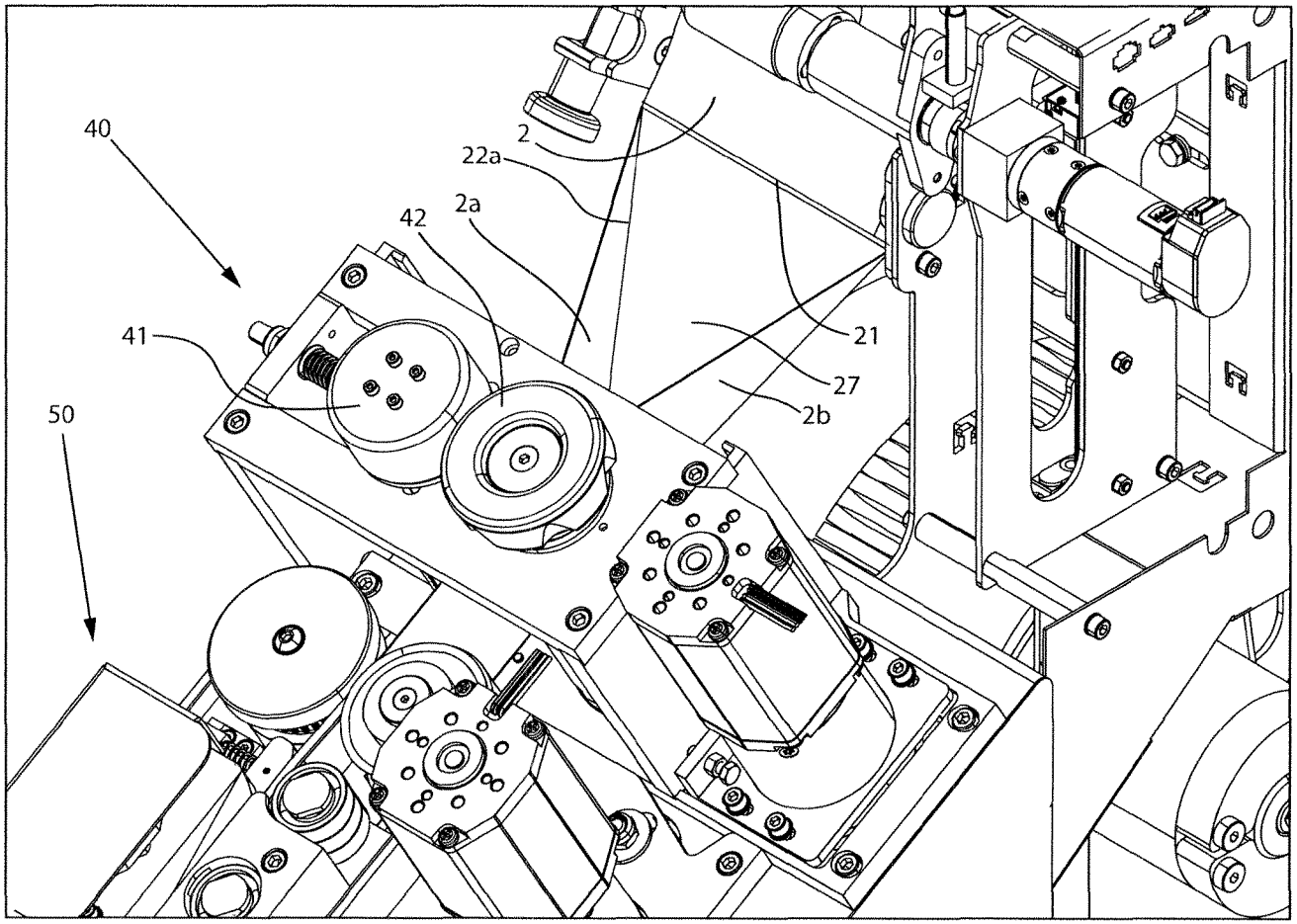
FIG. 2C is a perspective view of a portion of an embodiment of a packaging device.

As already indicated, the folding and guiding unit 20 may be embodied in multiple parts and may have a detachable pharmaceutical supply component 26 and a folding component 27. In FIG. 2C, the detachable pharmaceutical supply component 26 is omitted and only the flatly implemented, triangular folding component 27 can be seen. It can also be seen in FIG. 2C that the packaging material web 2, after it was guided at the packaging material receiving region 21 under the folding and guiding unit 20, protrudes at the two other lateral regions of the folding and guiding unit 20, the so-called packaging material web folding regions, of which only the "right" packaging material web folding region 22*a* in the movement direction can be seen.

Figure 2D:
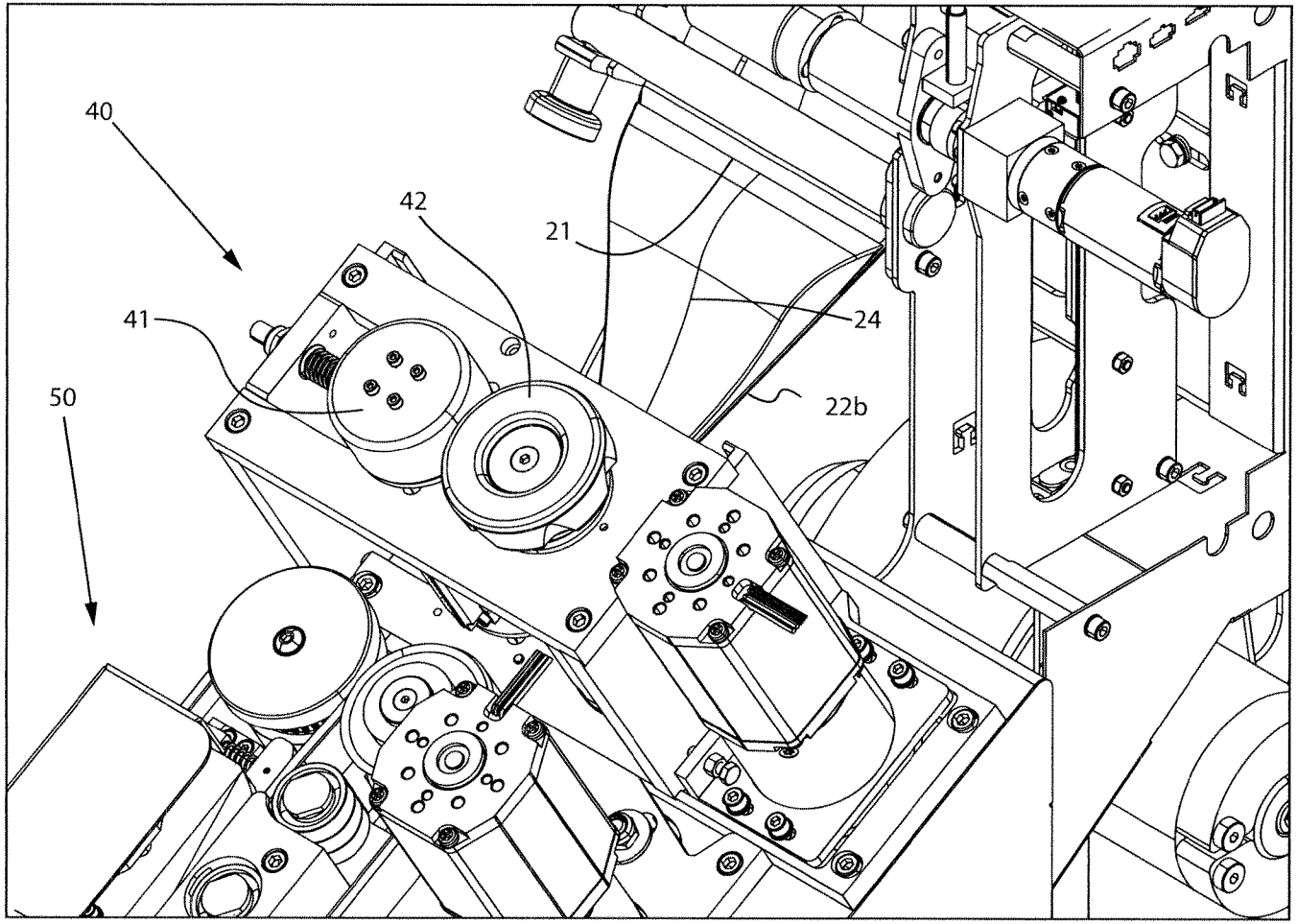
FIG. 2D is a perspective view of a portion of an embodiment of a packaging device.

In FIG. 2D, the complete folding and guiding unit 20 is shown. However, the packaging material web 2 is omitted, and the "left" packaging material web folding region 22*b* is visible in this illustration.

Figure 2E:
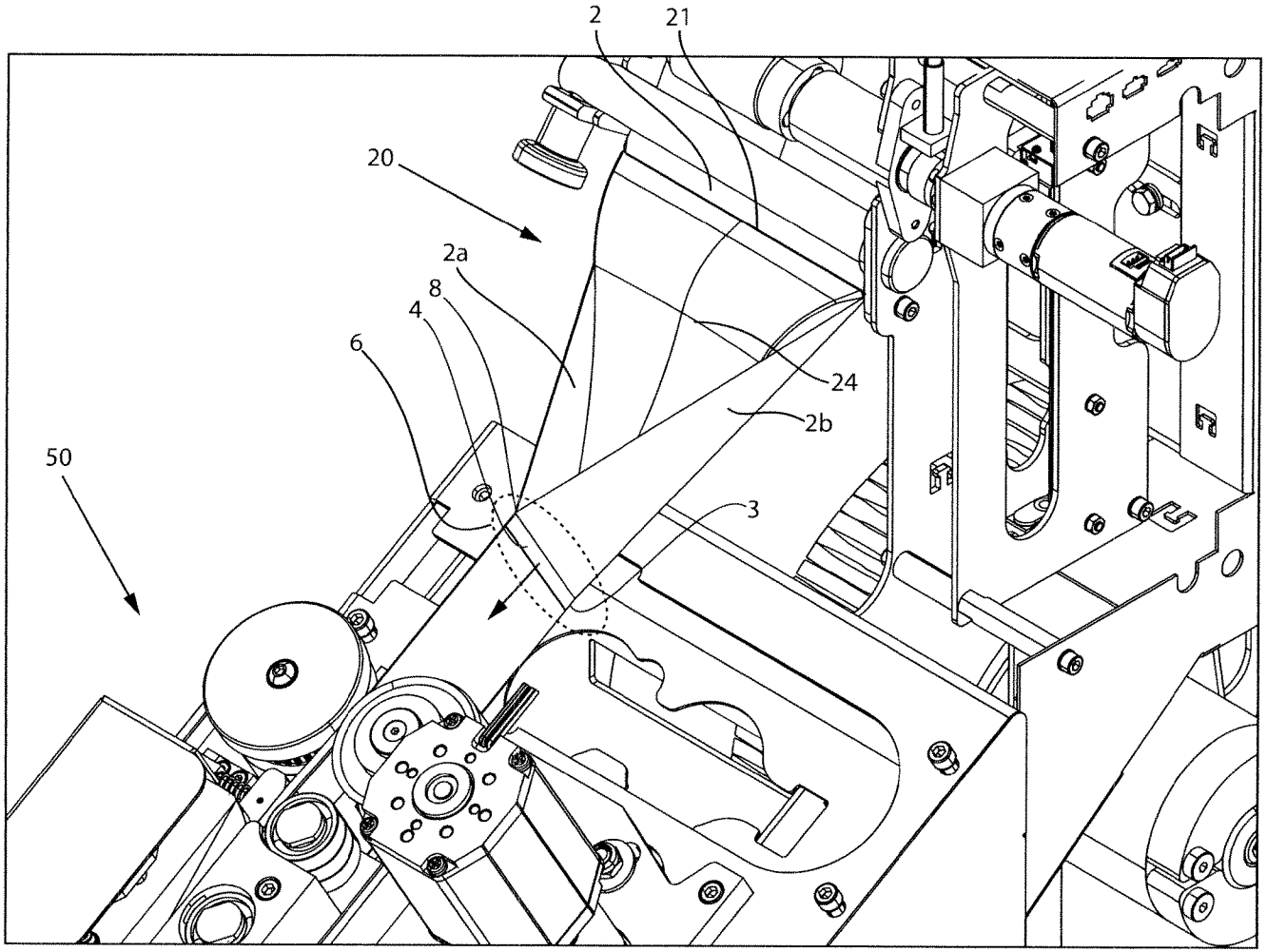
FIG. 2E is a perspective view of a portion of an embodiment of a packaging device.

In FIG. 2E, the first joining unit is omitted to illustrate the fold, in order to illustrate the region at which the folded packaging material web regions 2*a*, 2*b* come together, wherein this region 6 is only schematically illustrated. For example, it is indicated that the packaging material web regions 2*a*, 2*b* run together to a point 8 in the region 6, which is not entirely accurate in practice, since the region is continuously filled with medications, which deform the region.

The packaging material web 2/double web 2*c* is moved during the blister packaging through the packaging device 1, and the joining region 4 also moves further (e.g., in the direction of the arrow) with the web. The folded packaging material web and the folding and guiding unit 20 form a type of funnel, and medications to be blister packaged are conducted into this funnel via the folding and guiding unit 20 (see also FIG. 3B).

Figure 2F:
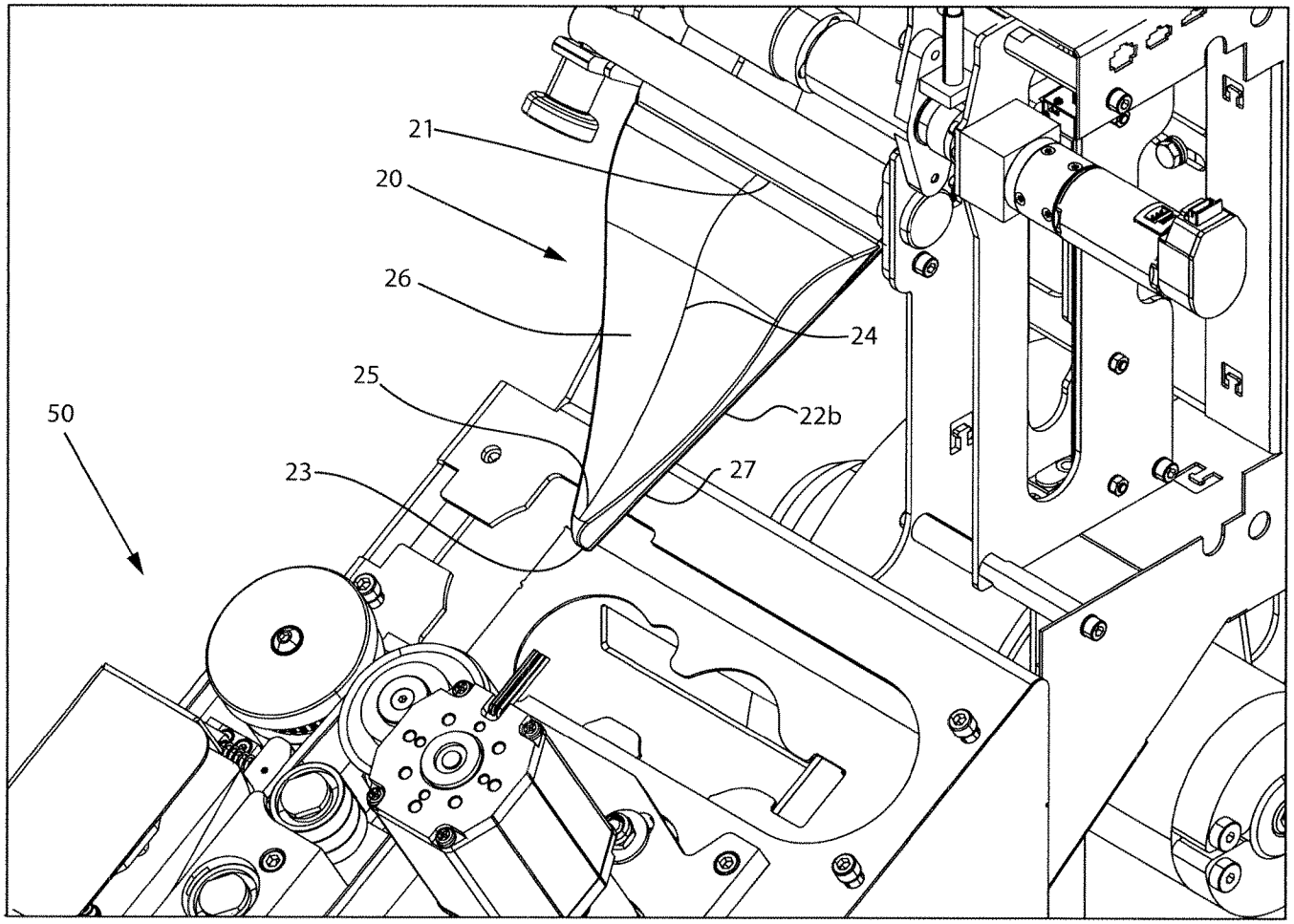
FIG. 2F is a perspective view of a portion of an embodiment of a packaging device.

In the illustration shown in FIG. 2F, both the first joining unit and also the packaging material web/double web are omitted, and the folding and guiding unit 20 according to this embodiment can be seen. In the embodiment shown, the folding and guiding unit 20 is constructed in two parts, having a lower folding component 27 and an upper medication supply component 26, wherein the medication supply component 26 is detachably fastened on the folding component 27. In the embodiment shown, the medication supply component 26 provides an impact region 24, from which medications to be packaged are supplied to the packaging region.

As can be seen in FIG. 2F, the two packaging material web folding regions 22*a*, 22*b*, which are provided in the present case by the folding component 27, run together in the folding section 23, which defines the folded region of the packaging material web 2. The medication supply component 26 has, in the region of the tip, a medication supply section 25, which is implemented spaced apart vertically (upward) from the folding section 23. Furthermore, it can be inferred in FIG. 2F that the surface of the medication supply component 26 is implemented as concave.

Figure 3A:
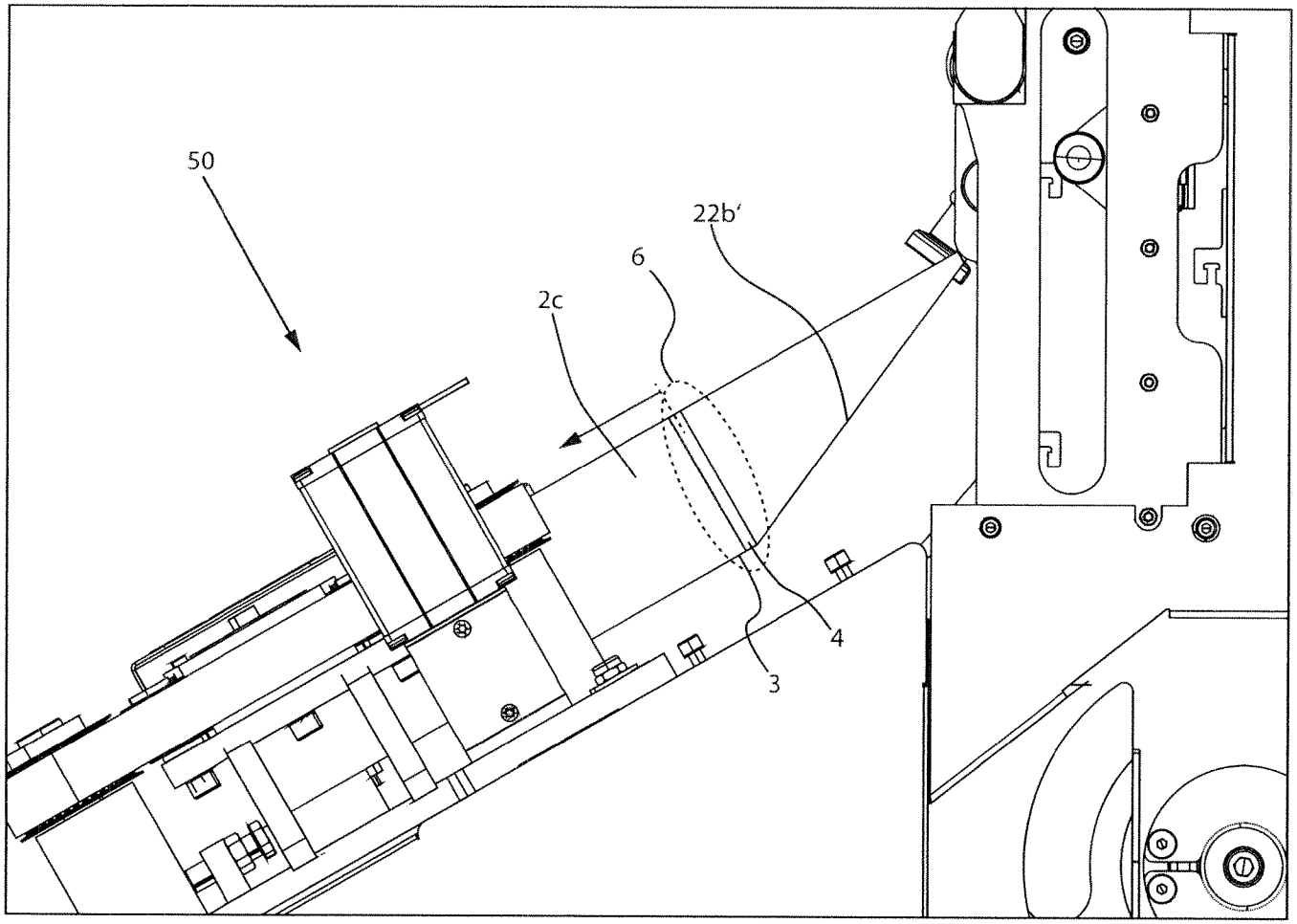
FIG. 3A is a side view of a portion of an embodiment of a packaging device.
Figure 3B:
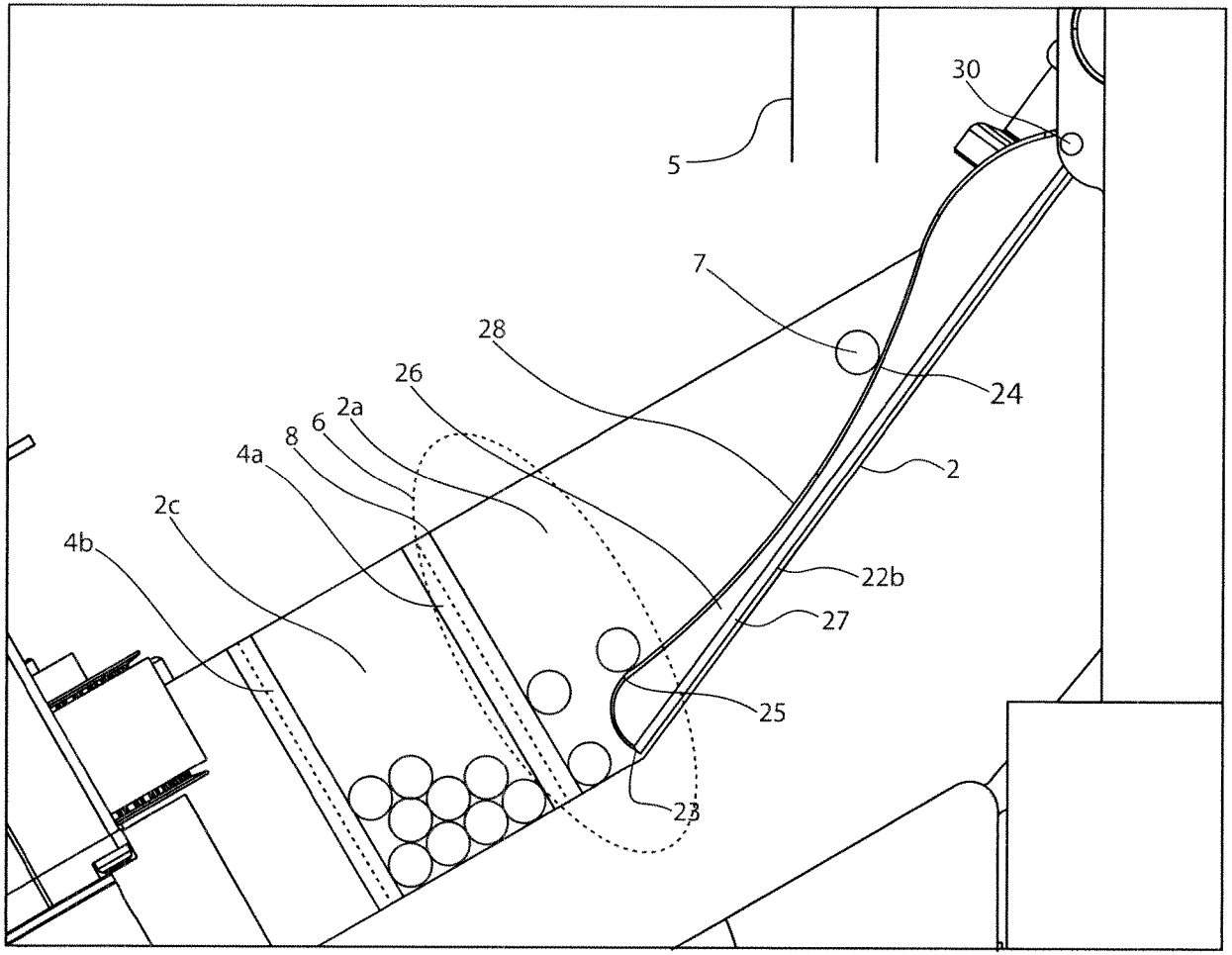
FIG. 3B is a side view of a portion of an embodiment of a packaging device.

FIGS. 3A and 3B show side views of the packaging device 1 in the region of the folding and guiding unit 20. In FIG. 3A, the first joining unit is omitted, to illustrate the course of the folding of the packaging material web 2 from the side. It can be seen in this illustration that the folding and guiding unit 20 itself is arranged inclined in the packaging device 1, and the folded packaging material web 2*c* is also guided further in an inclined manner after the folding.

FIG. 3B shows a further side view of the packaging device 1, wherein a part of the folded packaging material web 2, the region 2*b* from FIG. 3A, is omitted, so that the folding and guiding unit 20 can be seen. The folding and guiding unit 20 is pivotably connected to the packaging device 1 at pivot point 30. In the illustration according to FIG. 3B, a plurality of medications 7 are also shown, illustrating the supply of the medications 7 into the packaging region 6 and an arrangement of individual medications 7 in a blister pack that is still to be finished (e.g., delimited by joining regions 4*a*, 4*b*).

The provided medication set is supplied via a supply 5 to the folding and guiding unit 20, on which it is incident in the impact region 24. The concave embodiment of the surface 28 of the folding and guiding unit 20, which is formed in the embodiment shown from the medication supply component 26 and the folding component 27, causes the angle in the impact region 24 to be steeper in comparison to a surface which is not implemented as concave, so that the medications 7 are accelerated more strongly. The medication supply section 25 is implemented in the region of the tip of the folding and guiding unit 20, specifically vertically spaced apart from the folding section 23. The illustrated embodiment of the folding and guiding unit 20 has the effect that the medications 7 are not supplied to the packaging region 6 in the region of the fold 3, but rather vertically spaced apart from the folded region 3 in relation to the movement direction of the packaging material web 2.

The folding and guiding unit 20 forms a ski jump configuration, which effect is reinforced by the concave embodiment of the surface 28. As a result, the medications 7 are not simply deposited one after another in the folded region 3, but rather "jump" into the packaging region 6. They impact in the packaging region 6, in the "snapshot" shown in the present case against the vertical joining region 4*a*, and then fall in the direction of the folded region 3. In this manner, medications 7 may be arranged not only one after another (e.g., in the movement direction of the packaging material web), but also one on top of another, which has the result that the same number of medications 7 may be packaged in a smaller blister pack. A correspondingly produced blister pack is shown in FIG. 3B on the left of the joining region 4*a*. It can also be seen that a joining region 4*a* for the blister pack which was just produced represents the beginning of a new blister pack and represents the pack end for the preceding blister pack.

The precise manner of the depositing of the medications 7 in the packaging region 6 is dependent on the medications 7 themselves and the length of the blister pack. In the state shown, the medications 7 impact on the joining region 4*a* and then fall down. During the progression of the packaging material web 2, during which the joining region 4*a* moves further to the left, it can also occur that the medications 7 no longer impact on the joining region 4*a*, but rather simply arrive in the packaging region 6 spaced apart in the movement direction.

Figure 4C:
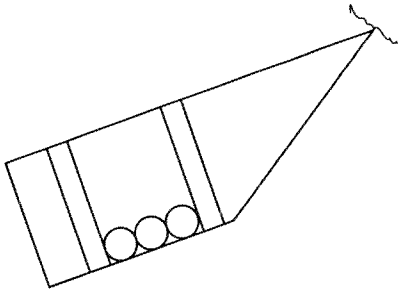
FIGS. 4A-4C are illustrations of providing a supply of medications into a folded packaging material web using an impact plate.
Figure 4B:
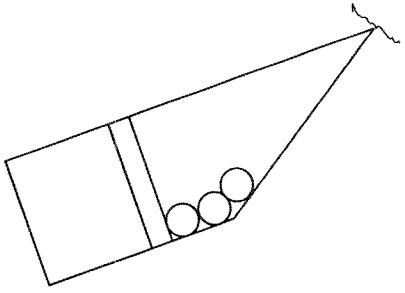
Figure 4A:
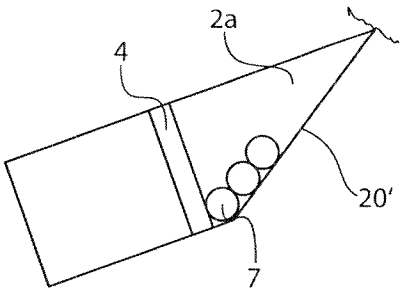
Figure 5C:
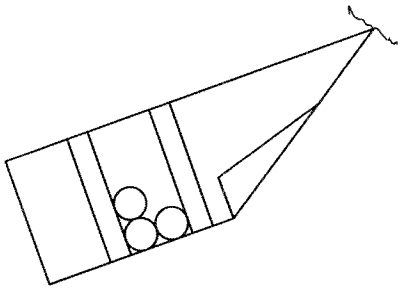
FIGS. 5A-5C are illustrations of providing a supply of medications into a folded packaging material web using an embodiment of a folding and guiding unit.
Figure 5B:
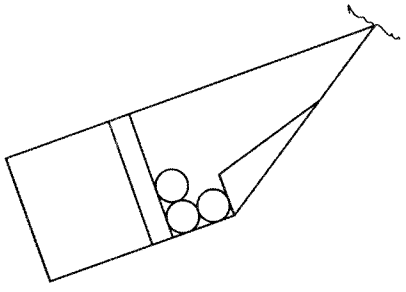
Figure 5A:
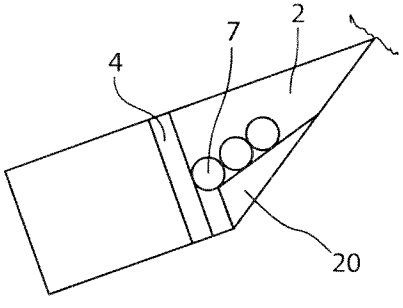

FIGS. 4A-4C and 5A-5C schematically show the difference in the production of blister packs using an impact plate and folding and guiding unit 20, wherein FIGS. 4A-4C show the production using an impact plate 20'.

FIGS. 6A-6D show various views of an embodiment of a folding and guiding unit 20, wherein the embodiment shown has a medication supply component 26 and a folding component 27. Here, the folding component 27 is implemented as a flat triangular plate. However, the lower side of the folding component 27 may also be implemented completely differently in other embodiments.

Figure 6B:
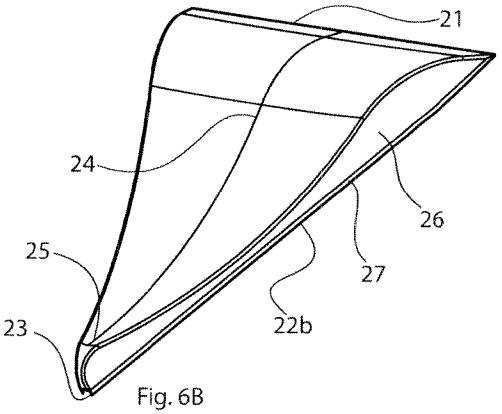
FIG. 6B is another perspective view of folding and guiding unit of FIG. 6A.
Figure 6D:
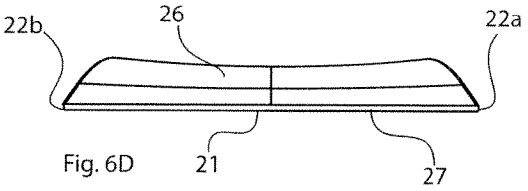
FIG. 6D is a rear view of folding and guiding unit of FIG. 6A.
Figure 6F:
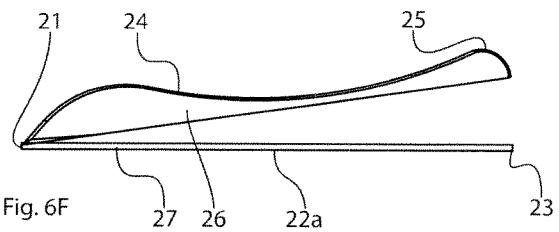
FIG. 6F is a side view of the folding and guiding unit of FIG. 6A in a pivoted position.
Figure 6A:
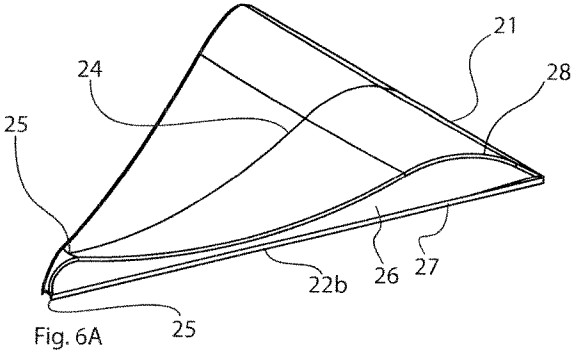
FIG. 6A is a perspective view of an embodiment of a folding and guiding unit.
Figure 6C:
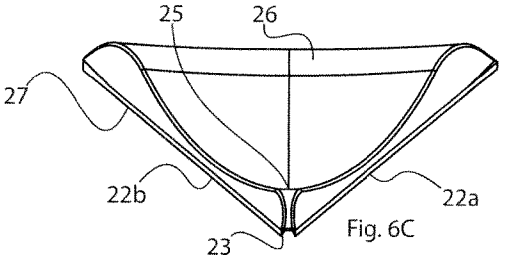
FIG. 6C is another perspective view of folding and guiding unit of FIG. 6A.

In the figures, in particular FIG. 6C, the concave embodiment of the surface of the medication supply component 26 is well visible. Furthermore, the packaging material web receiving region 21 and the packaging material web folding regions 22*a*, 22*b* are well visible, which are provided in the embodiment shown by the folding component 27.

Figure 6E:
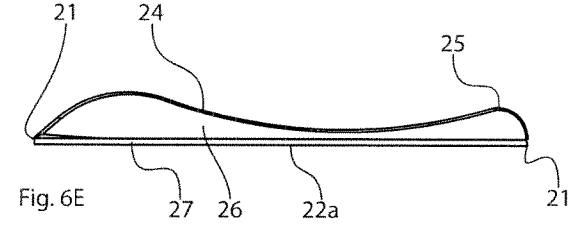
FIG. 6E is a side view of folding and guiding unit of FIG. 6A.

It is well visible in FIGS. 6E and 6F that the medication supply component 26 may be configured as pivotable in relation to the folding component 27, whereby an adaptation of the folding and guiding unit 20 to the medications 7 to be packaged or blister packaged is configurable.

Figure 7:
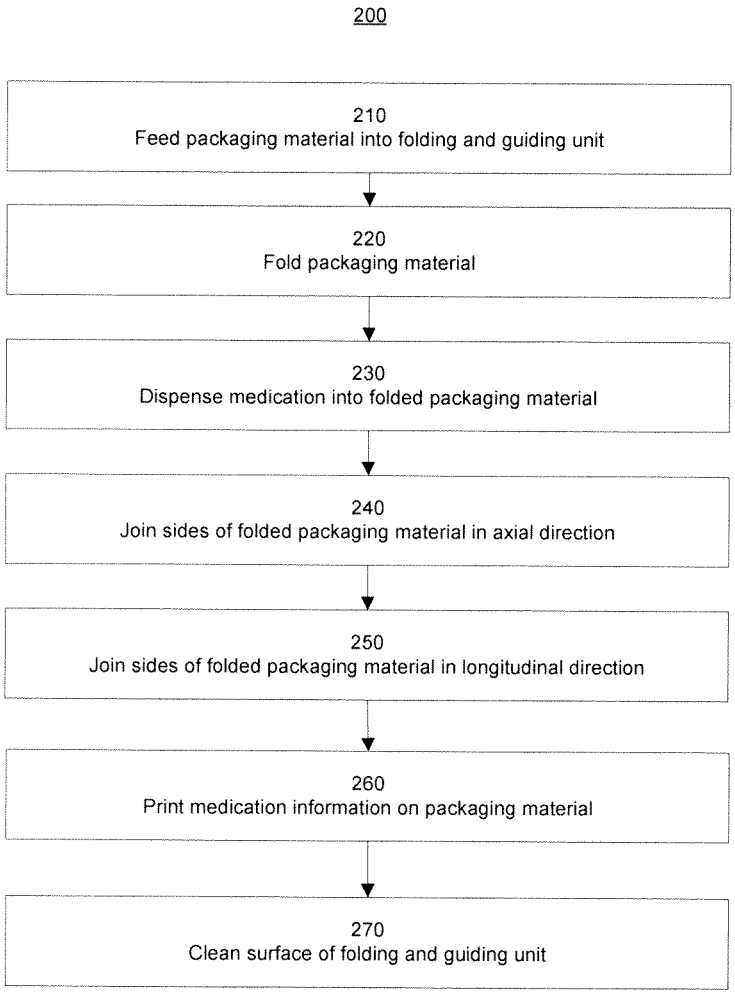
FIG. 7 is a flow chart illustrating steps in a method for packaging medications, according to some embodiments.

FIG. 7 shows a flow chart illustrating steps in a method 200 for packaging medications, according to some embodiments. Method 200 may be performed in connection with packaging device consistent with the present disclosure. Accordingly, the packaging device in method 200 may include a packaging material (e.g., packaging material web 2) provided to a guiding/folding unit (e.g., folding and guiding unit 20) that includes one or more joining units (e.g., first and second joining units 40, 50) through which the packaging material may be moved and folded. The packaging device in method 200 may also include one or more welding rollers (e.g., welding rollers 41, 42) for sealing portions of the packaging material web 2. The folding and guiding unit 20 in method 200 may also have supply and folding components (e.g., detachable pharmaceutical supply component 26 and folding component 27). Accordingly, medications (e.g., medications 7) may be dispensed into the folded packaging material for formation into individual blister packs.

Steps in method 200 may be performed at least partially by an operator, medical personnel, or a healthcare professional in a healthcare facility or in a drugstore, or in a pharma manufacturing facility. Accordingly, method 200 may be part of a medicament management or a drug logistic prepared by a physician or a healthcare professional. Moreover, method 200 may be performed automatically upon execution of a command provided by or controlled by a healthcare professional. For example, steps in method 200 may be programmed or directed with commands on computer-readable media, which, in some embodiments, can comprise non-transitory computer readable media.

Methods consistent with the present disclosure may include at least one of the steps illustrated in FIG. 7, performed in any order. In some embodiments, a method may include at least two of the steps illustrated in FIG. 7 performed overlapping in time, or even simultaneously. Moreover, embodiments consistent with the present disclosure may include at least one but not all of the steps illustrated in FIG. 7. Furthermore, methods consistent with the present disclosure may include more steps, in addition to at least one of the steps illustrated in FIG. 7. In some embodiments, one or more steps may be repeated.

Step 210 includes feeding a packaging material web into a folding and guiding device. Step 220 includes folding the packaging material web in a longitudinal direction into a funnel configuration. In some embodiments, step 220 includes folding the packaging material into a U-shape. Step 230 includes providing or dispensing medication to the folded portion or packaging region of the packaging material. In some embodiments, step 230 includes guiding the medication into the packaging region by an impact region of a folding and guiding unit. Step 240 includes joining the folded sides of the packaging material together in an axial or vertical direction by a first joining unit. Step 250 includes joining the open longitudinal sides of the packaging material together in the longitudinal direction by a second joining unit, forming individual blister packs containing the dispensed medications. Step 260 includes printing medication information on the packaging material. In some embodiments, step 260 includes printing medication information on the packaging material before it is fed into the folding and guiding unit. Step 270 includes cleaning the surface of the folding and guiding unit with cleaning fluid by a cleaning unit. In some embodiments, step 270 includes applying a fluid to the surface of the folding and guiding unit to flush any adhering contaminants into the packaging material web, which is then joined together to form a pouch and subsequently disposed of.

It is understood that any specific order or hierarchy of blocks in the methods of processes disclosed is an illustration of example approaches. Based upon design or implementation preferences, it is understood that the specific order or hierarchy of blocks in the processes may be rearranged, or that all illustrated blocks be performed. In some implementations, any of the blocks may be performed simultaneously.

The present disclosure is provided to enable any person skilled in the art to practice the various aspects described herein. The disclosure provides various examples of the subject technology, and the subject technology is not limited to these examples. Various modifications to these aspects will be readily apparent to those skilled in the art, and the generic principles defined herein may be applied to other aspects.

A reference to an element in the singular is not intended to mean "one and only one" unless specifically so stated, but rather "one or more." Unless specifically stated otherwise, the term "some" refers to one or more. Pronouns in the masculine (e.g., his) include the feminine and neuter gender (e.g., her and its) and vice versa. Headings and subheadings, if any, are used for convenience only and do not limit the invention.

The word "exemplary" is used herein to mean "serving as an example or illustration." Any aspect or design described herein as "exemplary" is not necessarily to be construed as preferred or advantageous over other aspects or designs. In one aspect, various alternative configurations and operations described herein may be considered to be at least equivalent.

As used herein, the phrase "at least one of" preceding a series of items, with the term "or" to separate any of the items, modifies the list as a whole, rather than each item of the list. The phrase "at least one of" does not require selection of at least one item; rather, the phrase allows a meaning that includes at least one of any one of the items, and/or at least one of any combination of the items, and/or at least one of each of the items. By way of example, the phrase "at least one of A, B, or C" may refer to: only A, only B, or only C; or any combination of A, B, and C.

A phrase such as an "aspect" does not imply that such aspect is essential to the subject technology or that such aspect applies to all configurations of the subject technology. A disclosure relating to an aspect may apply to all configurations, or one or more configurations. An aspect may provide one or more examples. A phrase such as an aspect may refer to one or more aspects and vice versa. A phrase such as an "embodiment" does not imply that such embodiment is essential to the subject technology or that such embodiment applies to all configurations of the subject technology. A disclosure relating to an embodiment may apply to all embodiments, or one or more embodiments. An embodiment may provide one or more examples. A phrase such an embodiment may refer to one or more embodiments and vice versa. A phrase such as a "configuration" does not imply that such configuration is essential to the subject technology or that such configuration applies to all configurations of the subject technology. A disclosure relating to a configuration may apply to all configurations, or one or more configurations. A configuration may provide one or more examples. A phrase such a configuration may refer to one or more configurations and vice versa.

In one aspect, unless otherwise stated, all measurements, values, ratings, positions, magnitudes, sizes, and other specifications that are set forth in this specification, including in the claims that follow, are approximate, not exact. In one aspect, they are intended to have a reasonable range that is consistent with the functions to which they relate and with what is customary in the art to which they pertain.

It is understood that the specific order or hierarchy of steps, operations or processes disclosed is an illustration of exemplary approaches. Based upon design preferences, it is understood that the specific order or hierarchy of steps, operations or processes may be rearranged. Some of the steps, operations or processes may be performed simultaneously. Some or all of the steps, operations, or processes may be performed automatically, without the intervention of a user. The accompanying method claims, if any, present elements of the various steps, operations or processes in a sample order, and are not meant to be limited to the specific order or hierarchy presented.

All structural and functional equivalents to the elements of the various aspects described throughout this disclosure that are known or later come to be known to those of ordinary skill in the art are expressly incorporated herein by reference and are intended to be encompassed by the claims. Moreover, nothing disclosed herein is intended to be dedicated to the public regardless of whether such disclosure is explicitly recited in the claims. No claim element is to be construed under the provisions of 35 U.S.C. § 112 (f) unless the element is expressly recited using the phrase "means for" or, in the case of a method claim, the element is recited using the phrase "step for." Furthermore, to the extent that the term "include," "have," or the like is used, such term is intended to be inclusive in a manner similar to the term "comprise" as "comprise" is interpreted when employed as a transitional word in a claim.

The Title, Background, Summary, Brief Description of the Drawings and Abstract of the disclosure are hereby incorporated into the disclosure and are provided as illustrative examples of the disclosure, not as restrictive descriptions. It is submitted with the understanding that they will not be used to limit the scope or meaning of the claims. In addition, in the Detailed Description, it can be seen that the description provides illustrative examples and the various features are grouped together in various embodiments for the purpose of streamlining the disclosure. This method of disclosure is not to be interpreted as reflecting an intention that the claimed subject matter requires more features than are expressly recited in each claim. Rather, as the following claims reflect, inventive subject matter lies in less than all features of a single disclosed configuration or operation. The following claims are hereby incorporated into the Detailed Description, with each claim standing on its own as a separately claimed subject matter.

The claims are not intended to be limited to the aspects described herein, but are to be accorded the full scope consistent with the language claims and to encompass all legal equivalents. Notwithstanding, none of the claims are intended to embrace subject matter that fails to satisfy the requirement of 35 U.S.C. § 101, 102, or 103, nor should they be interpreted in such a way.

What is claimed is:

1. A packaging device for medications, comprising:

a packaging material supply configured to supply a flexible, elongated packaging material web from a storage roll;

a folding and guiding unit disposed downstream of the packaging material supply, the folding and guiding unit comprising:

a packaging material web receiving region;

first and second packaging material web folding regions configured to run together in a folding section;

an impact region, wherein the surface of the folding and guiding unit comprising the impact region is concave; and a medication supply section, wherein the folding and guiding unit is configured to fold the packaging material web in a longitudinal direction so that edges of the packaging material web are guided along the first and second packaging material web folding regions and a folded region in the packaging material web is formed by the folding section, wherein the impact region is configured for medications to be packaged, and wherein the medication supply section is spaced apart from the folding section, the medication supply section configured to guide medications vertically spaced apart from the folded region into the folded packaging material web;

a first joining unit disposed downstream of the folding and guiding unit and configured to join together the folded packaging material web in an axial direction; and a second joining unit disposed downstream of the folding and guiding unit and configured to join together the folded packaging material web in a longitudinal direction.

2. The packaging device for medications according to claim 1, wherein the folding and guiding unit further comprises:

a detachable medication supply component; and a folding component, wherein the medication supply section is configured as part of the detachable medication supply component and the folding section is configured as part of the folding component.

3. The packaging device for medications according to claim 2, wherein the detachable medication supply component is pivotally mounted, wherein the medication supply section of the medication supply component is configured to be axially adjustable in relation to the folding region.

4. The packaging device for medications according to claim 3, wherein the medication supply component is configured to vary a distance between an upper side of the medication supply section and a lower side of the folded section based on varying an axial pivotal position of the medication supply component.

5. The packaging device for medications according to claim 1, wherein one or more sections of a surface of the impact region comprises an anti-adhesive coating.

6. The packaging device for medications according to claim 1, wherein the folding and guiding unit further comprises a cleaning unit configured to remove contaminants adhering to the surface of the folding and guiding unit.

7. The packaging device for medications according to claim 1, wherein the packaging device further comprises a marking unit disposed upstream of the folding and guiding unit.

8. The packaging device for medications according to claim 1, wherein the folding and guiding unit is configured to continuously fold the packaging material web to have a U-shaped cross section.

9. The packaging device for medications according to claim 1, wherein the medication supply section is configured in a tip of the folding and guiding unit, providing a surface of the folding and guiding unit with a ski jump configuration.

10. A method for packaging medications, the method comprising:

feeding a packaging material web into a folding and guiding device;

folding the packaging material web in a longitudinal direction into a funnel configuration, the folded packaging material web comprising a packaging region;

guiding, by an impact region of the folding and guiding device, one or more dispensed medications into the packaging region, wherein the dispensed medications are guided into the packaging region by a ski jump configured surface of the impact region;

joining opposing sides of the folded packaging material web together in an axial direction by a first joining unit;

joining opposing longitudinal sides of the folded packaging material web together in a longitudinal direction by a second joining unit, the opposing longitudinal sides of the folded packaging material web disposed opposite a fold in the folded packaging material web, wherein the axially and longitudinally joined folded packaging material web comprises a sealed package containing the dispensed medications.

11. The method according to claim 10, wherein the joining opposing sides of the folded packaging material web together in an axial direction comprises joining a location of the folded packaging material web upstream of the dispensed medications to form a second axial seal, wherein a first axial seal is disposed downstream of the dispensed medications, the first axial seal having been formed as an upstream axial seal of a previous sealed package.

12. The method according to claim 10, wherein the joining opposing sides of the folded packaging material web together in an axial direction comprises joining a first location of the folded packaging material web downstream of the dispensed medications to form a first axial seal and joining a second location of the folded packaging material web downstream of the dispensed medications to form a second axial seal, wherein each sealed package comprises separate first and second axial seals.

13. The method according to claim 10, wherein the guiding the one or more dispensed medications into the packaging region comprises guiding a plurality of medications axially against a first axial seal.

14. The method according to claim 10, further comprising:

pivotally positioning a detachable medication supply component to configure a distance between an upper side of a supply section of the detachable medication supply component and a lower side of a folding section of the folding and guiding device, wherein the disposition of medications within a sealed package is based on the configured distance.

15. The method according to claim 10, further comprising:

guiding split off medication particles into the folding packaging material web by sections of the impact region comprising an anti-adhesive coating.

16. The method according to claim 10, further comprising:

applying a fluid to a surface of the folding and guiding unit; and flushing contaminants adhering to the surface of the folding and guiding unit and the fluid into the folded packaging material web.

17. The method according to claim 16, further comprising:

sealing the flushed contaminants and fluid in a sealed package.

18. A packaging device, comprising:

a folding and guiding unit comprising:

an impact region;

first and second packaging material web folding regions configured to fold a packaging material web in a longitudinal direction to form a folded packaging material web having a longitudinal fold; and a medication supply section configured to guide a plurality of medications into the folded packaging material web, wherein two or more of the plurality of medications are disposed next to one another axially from the longitudinal fold;

a detachable medication supply component; and a folding component, wherein the medication supply section is configured as part of the detachable medication supply component and the folding regions are configured as part of the folding component;

a first joining unit configured to join together the folded packaging material axially from the longitudinal fold; and a second joining unit configured to join together the folded packaging material web longitudinally opposite the longitudinal fold.

* * * * *